United States Patent [19]

Bohg et al.

[11] 4,412,197

[45] Oct. 25, 1983

[54] ELECTROMAGNETIC RAM ACTUATOR

[75] Inventors: Armin Bohg, Weil im Schoenbuch; Kurt Hartmann, Calw-Heumaden, both of Fed. Rep. of Germany

[73] Assignee: International Business Machines Corporation, Armonk, N.Y.

[21] Appl. No.: 364,091

[22] Filed: Mar. 31, 1982

[30] Foreign Application Priority Data

Apr. 11, 1981 [DE] Fed. Rep. of Germany ..... 3114834

[51] Int. Cl.[3] ..... H01F 7/08

[52] U.S. Cl. ..... 335/256; 335/266; 101/93.48

[58] Field of Search ..... 335/266, 256, 259, 267, 335/268, 264, 265; 310/24, 30; 101/93, 93.48

[56] References Cited

U.S. PATENT DOCUMENTS

| | | | |
|---|---|---|---|
| 2,935,663 | 5/1960 | Pollak | 335/259 |
| 3,335,659 | 8/1967 | Schacht et al. | 101/93 |
| 3,491,319 | 1/1970 | Cox et al. | 335/259 |

*Primary Examiner*—Harold Broome

*Attorney, Agent, or Firm*—G. A. Conley; E. W. Galbi; J. Jancin, Jr.

[57] ABSTRACT

An electromagnet consists of two essentially symmetrically designed magnetizable E-shaped yoke halves each embraced by a coil. The facing pole ends of the yoke halves form three aligned operating gaps. Between the operating gaps a tongue-shaped ram is arranged which is shiftable in the direction of the line of alignment of the operating gaps. The cross-section of the ram is adapted to the area of the operating gaps. The ram comprises cuboid-shaped armature bars of magnetizable material. The armature bars are geometrically designed in such a manner that their volume is on the order of magnitude of the operating gap volume. In the original position of the ram the armature bars are essentially positioned in front of the operating gaps of the electromagnet. Upon excitation of the electromagnet, the armature bars are pulled into its operating gaps, being accelerated in the process.

The windings of the coils exciting the yoke halves are essentially positioned between the E-legs of the yoke halves.

By transverse connecting means made of the same material as themselves, the armature bars may be connected to form a continuous part. In view of the operation of the actuator, these transverse connecting means do not have the same material thickness as the armature bars, that is, they take the form of narrow connecting strips between the armature bars.

5 Claims, 7 Drawing Figures

A-A

ELECTROMAGNETIC RAM ACTUATOR

DESCRIPTION

1. Technical Field

The invention relates to an electromagnetic ram actuator, wherein the electromagnet consists of two essentially symmetrically designed magnetizable yoke halves embraced by one coil each, whose pole ends face each other to form aligned operating gaps. A ram is arranged between the operating gaps. The ram is shiftable in the direction of the line of alignment of the operating gaps. Armature bars are also associated with the operating gaps.

2. Background Art

Relevant electromagnetic ram actuator art, as described in U.S. patent application Ser. No. 162,993 filed June 25, 1980, is particularly suitable for use in impact printers.

In German Patent Application No. P 31 14 835.2, filed on the same date and having the same priority as the German Patent Application No. P 31 14 834.4 of which this application is the U.S. counterpart, a bank for accommodating several print ram units is described.

These print ram units consist, as described and illustrated in application Ser. No. 162,993 above, of a flat frame 6 between whose sides a tongue-shaped ram 34 is positioned in a recess (see FIG. 1 and FIG. 2 of this application). Print head 32 is fixed to the operating end of ram 34. Print ram 34 is capable of moving in the direction of print D marked by the arrow (or in a direction opposite thereto). Its lateral movement is prevented by electromagnetic actuators 10 and 11 fixed to the frame. These electromagnetic actuators may be fixed to the frame by gluing, screwing, riveting or other conventional methods. At the rear end of the tongue-shaped ram 34 there are two bores 35. The rear base part of the U-shaped frame is also provided with two bores 27. Bores 35 and 27 serve to suspend two tension springs 36, returning the deflected print ram to its starting position. The starting position is defined by stop 25. In the base of the U-shaped frame, pin 26 is fixed and designed as an extension of stop 25 and aligned in the direction D. By activating the electromagnetic actuators, the ram is accelerated in the operating direction D. Having impacted the print type, not shown, or the record carrier, not shown, the print ram is returned to its starting position by the tension of springs 36.

The electromagnetic actuating principle, on which the subject matter of the present application is also based, is described in the patent application Ser. No. 162,993 above. However, the embodiment of the electromagnet pairs described in the application and the design of the soft-iron bar structure in the tongue-shaped ram have a number of disadvantages.

DISCLOSURE OF THE INVENTION

The disadvantages of the prior art electromagnets above are attributable to the following facts: The U-shaped magnet yokes or the magnet yokes series-connected in the form of comb structures carry the windings on their base part. Comblike magnet yoke structures are known from U.S. application Ser. No. 261,312 filed May 7, 1981, as will be described in detail in conjunction with FIG. 7 of the present application. This leads to a greater spatial volume of the electromagnet units in the direction perpendicular to the plane of the tongue-shaped ram. This fact has a particularly adverse effect on the desired high pitch density of such ram units in a bank. Another fact is that it is difficult and expensive to apply the coils to the magnet yokes. In addition, the outer coil elements lead to undesirable magnetic interaction with the neighboring units.

The soft-iron bar structure in the tongue-shaped ram of the embodiment according to application Ser. No. 162,993 above also has a number of disadvantages. It is difficult, for example, while observing the necessary tolerances, to readily introduce such soft-iron bars into the tongue-shaped ram body otherwise made of plastic.

Therefore, it is the object of the present invention to provide an electromagnetic ram actuator avoiding the afore-mentioned disadvantages.

The improvements are to concern the spatial volume of the electromagnet units and the bar structures to be inserted into the tongue-shaped print ram body as well as a reduced interaction between adjacent electromagnet units.

BRIEF DESCRIPTION OF THE DRAWING

An embodiment of the invention is shown in the drawings and will be described in detail below.

BEST MODE FOR CARRYING OUT THE INVENTION

Figure 3:
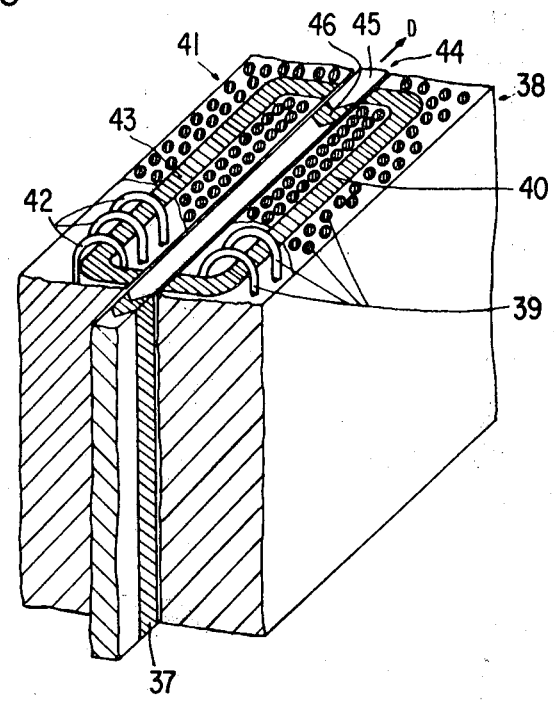
FIG. 3 is a schematic simplified representation of the principle of the print ram actuator.

FIG. 3 is a schematic perspective representation of an electromagnetic print ram actuator according to the patent application Ser. No. 162,993 above. A tongue 44 movable in the direction of arrow D is located between two fixed stator halves 41 and 38. Each of the stator halves 41 and 38 consists of one magnetizable yoke 43 and 40, respectively, which is embraced by coil windings 42 and 39, respectively. The stator yokes may be, for example, semicircularly, semieliptically or U-shaped. The stator yokes 43 and 40 in the two stator halves 41 and 38 are aligned in such a manner that the facing yoke ends are in alignment. When the coils 42 and 39 are excited, the magnetic flux extends from one yoke across an operating gap, in which an armature bar 46 is arranged, to the yoke of the other stator half and then across a further operating gap back to the former yoke, so that the magnetic circuit consists of the two stator yokes and the two operating gaps between the ends of the stator yokes.

For the sake of simplicity, the stator halves facing each other will be referred to below as stator pairs rather than as stator half pairs.

The current flow in the excitation coils 42 and 39 proceeds in such a manner that the current direction in the windings inside the two stator yokes facing each other is the same and opposite to that in the windings outside the stator yokes. In the front part of the representation of FIG. 3 the windings are diagrammatically represented by several wire loops, whereas the rear part shows a sectional representation of the wires. The tongue 44 which is movably arranged in the direction of arrow D between the stator halves 41 and 38 is much smaller in the direction of the operating gap than in its other two dimensions. The body of the tongue 44 consists of a light, magnetically non-conductive material. Magnetically conductive armature bars 46 and 37 are arranged in the tongue 44 in such a manner that upon excitation of the stator halves, they are pulled from a starting rest position into the space formed between the stator yokes, being accelerated in the process. Subsequently, the tongue is capable of performing a further movement in the direction of arrow D. The design of the armature bars 46 and 37 is essentially such that their volume would approximately fill the space between the ends of the stator yokes facing each other.

The path covered by the tongue from the starting position to the position after completion of the acceleration phase (when the armature bar is in the operating gap) is referred to as the acceleration stroke; the sum of the acceleration stroke and the subsequent further displacement of the tongue in the direction of arrow D is referred to as the operating stroke. This value depends upon boundary conditions connected with the design of the arrangement as well as upon the means provided for supporting the tongue and returning it to its starting position, respectively. Such means may take the form of well-known return springs, not shown: For example, as described in U.S. Pat. No. 3,335,659, one spring in connection with a sliding bearing of the tongue or a return spring interacting with a tongue pivotable about an axis. It is also possible to use electromagnetic restoring means.

FIG. 3 shows that the coil windings extend around the base of the U-shaped yoke halves. In other words, the windings are arranged inside and outside the yoke pair. The cost involved in applying such windings and the space requirements are relatively substantial. To avoid these disadvantages, the subject matter of the present invention utilizes in particular the design of the yoke halves in accordance with the invention in conjunction with the application of the windings.

Figure 7:
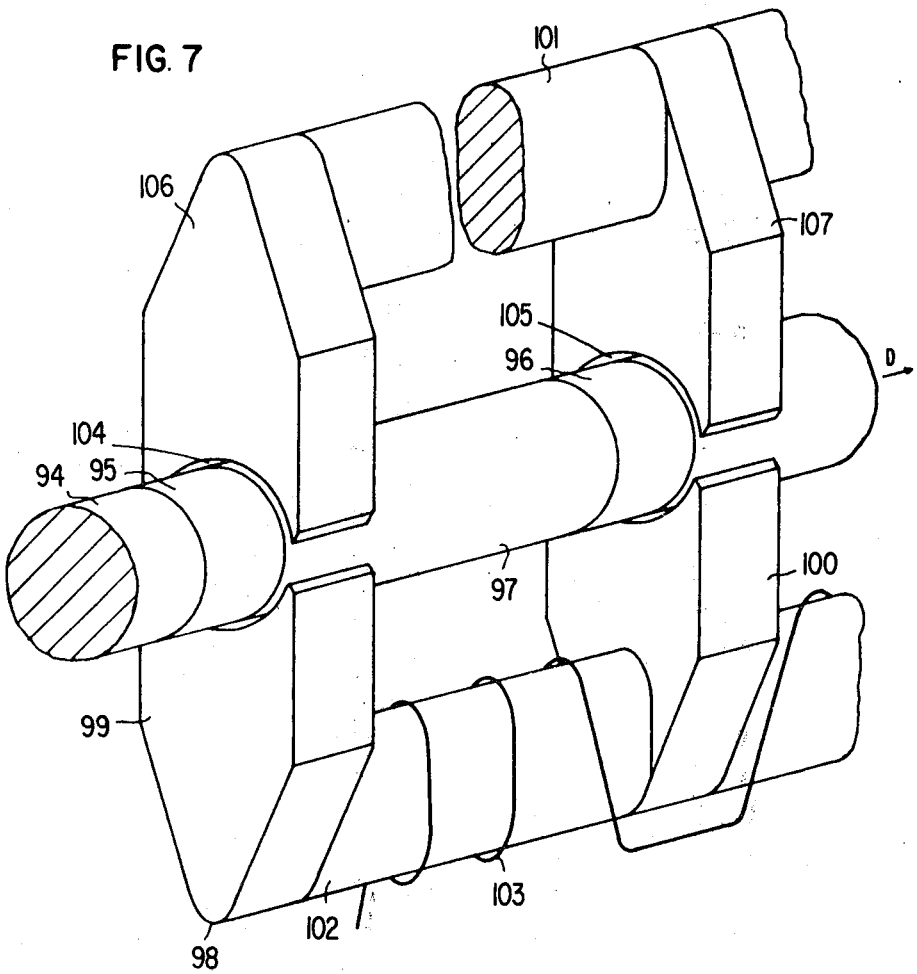
FIG. 7 is a schematic perspective representation of a ram actuator in which a cylindrical print ram extends in the essentially circular operating gaps of two yoke halves facing each other.

It is pointed out that the U-shaped yoke halves in accordance with FIG. 7 of the patent application Ser. No. 261,312 above may also be series-connected, with the excitation coil embracing again only their bases.

In accordance with the patent application Ser. No. 261,312 above, an electromagnet with an operating gap, into which a shiftable element containing soft-magnetic material is pulled, is characterized in that the electromagnet 98 consists of two magnetizable yoke halves 99, 100, 102; 106, 107, 101, at least one of which is embraced by a coil 103; that the facing, essentially semicircularly recessed pole ends of the yoke halves, forms essentially circular operating gaps 104, 105 which are aligned to each other; that a ram 94 shiftable in the direction of the line of alignment of the operating gaps and having a cross-section adapted to the area of the operating gaps is arranged between the pole ends of the yoke halves; that the ram 94 has two armature disks 95, 96 of magnetizable material and a spacer element 97 arranged therebetween, which predominantly consists of magnetizable material; that one armature disk 95, 96 is associated with each operating gap 104, 105; that the geometrical design of the armature disks 95, 96 is such that their volume is of the order of magnitude of the space between the facing pole ends of the yoke halves and that armature disks 95, 96, in the starting position of ram 94 in the non-excited state of the electromagnet are positioned in front of its operating gaps 104, 105, being pulled into these operating gaps upon excitation of the electromagnet.

Figure 1:
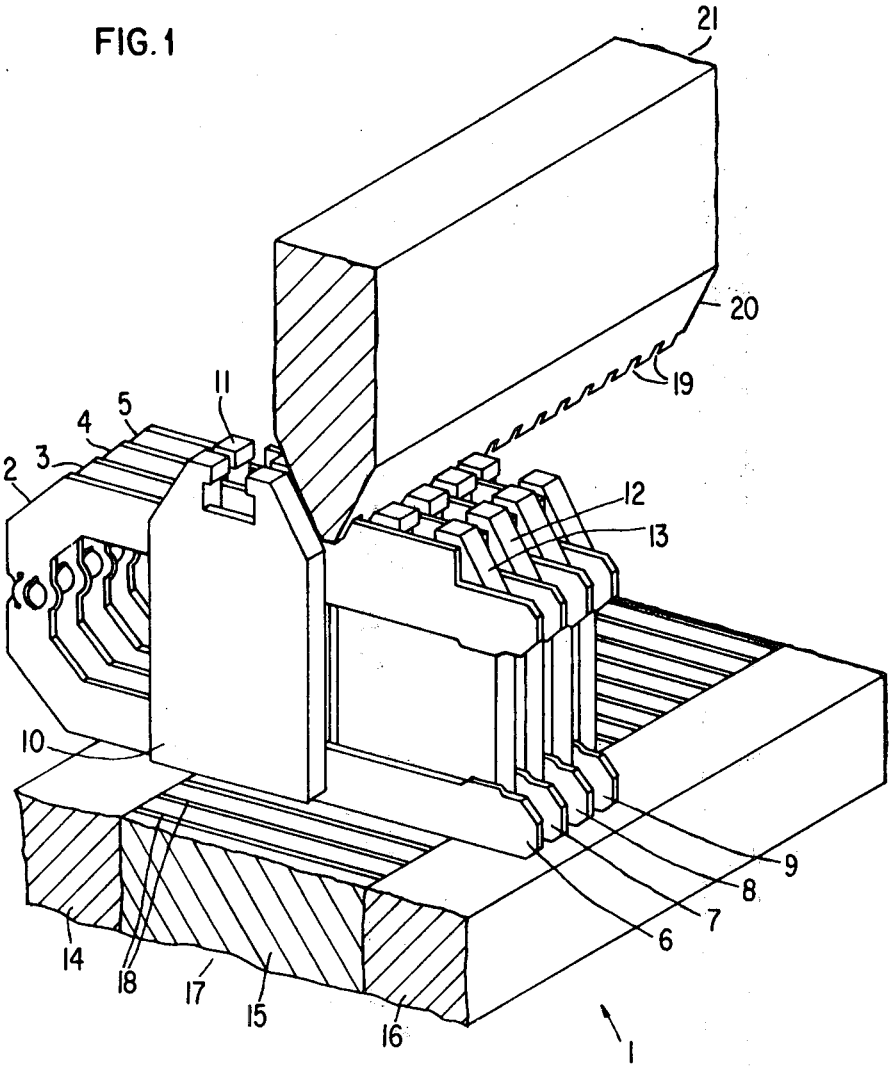
FIG. 1 is a perspective simplified representation of a bank for accommodating several print ram units.

FIG. 1 is a perspective view of a bank for accommodating several print ram units. The print ram units, of which for the sake of simplicity, only four units (without the print rams) are shown, are designated as 2, 3, 4 and 5. The frames of these print ram units are designated as 6, 7, 8 and 9. Each print ram unit is associated with a pair of electromagnetic actuators for the print ram. The electromagnetic actuators for print ram unit 2 are designated as 10 and 11 and are arranged in alignment to each other on both sides of frame 6.

Electromagnetic actuators, as may be used for the bank described here, are covered by the application Ser. No. 162,993 above.

FIG. 1 shows how the individual print ram units are accommodated in the print hammer bank. The print hammer band consists of a lower part 17 and a comblike upper part 21. The lower part 17 is referred to below as the base part and the upper part 21 as the comb part. The base part is made up of two bars 14, 16 extending parallel to each other and a part 15 arranged therebetween with slits 18. The slits extend parallel to each other and are longitudinally limited by bars 14 and 16. They each serve to accommodate one lower extension piece (see FIG. 2 and FIG. 4) of the print ram frame.

The comb part 21 of the bank consists of a sloped part 20 which at its tapered side, resulting from the slope, is provided with comblike recesses 19. These comblike recesses are aligned to slits 18 in base part 17. Each of these comblike recesses 19 embraces a part of the upper end of the frame of the individual print ram units. Thus, the individual print ram units are held in place. Lateral displacement is prevented by the slits 18 and the comblike recesses 19, respectively; vertical displacement is prevented by the position of the print ram units between base part 17 and comb part 21, whereas displacement in the operating direction of the print ram, not shown, parallel to the direction of slits 18 and opposite thereto, respectively, is prevented or can be influenced, as desired, by suitably accommodating lower frame extension 30 in slits 18. This is particularly important for damping the recoil of the ram on the print hammer bank. Further details on this will be provided in connection with FIG. 2.

It has already been mentioned, for example, that on either side of the frame 6 of the print ram unit 2 there is one electromagnetic actuator 10 which is aligned to another actuator 11. To ensure that the print rams in the bank are densely packed, the electromagnetic actuators are staggered in pairs, so that the spacing of two adjacent frames is determined by the thickness of one electromagnetic actuator. As may be seen from FIG. 1, electromagnetic actuators 10 and 11 of the print ram unit 2 are staggered relative to electromagnetic actuators 13 and 12 of print ram unit 3.

For the sake of clarity, the electromagnetic actuators for print ram unit 4 are not shown in FIG. 1.

Figure 2:
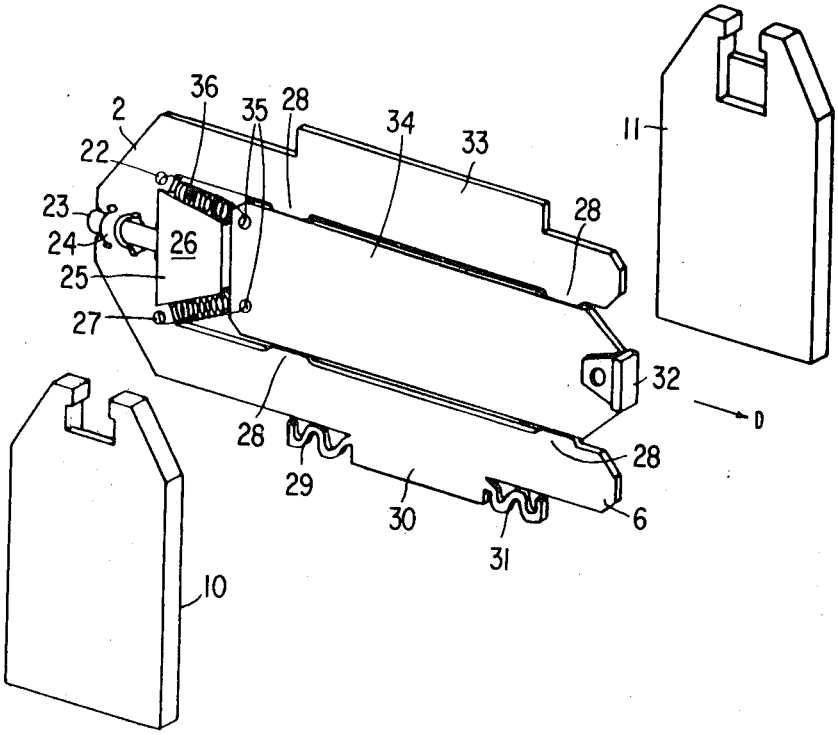
FIG. 2 is a simplified perspective exploded representation of a print ram unit with its associated electromagnetic actuators for the tongue-shaped ram, which are arranged on either side of its frame.

The representations of FIG. 1 and FIG. 2 were derived from the German Patent Application No. P 31 14 835.2 which was filed on the same date as the German counterpart to the present application.

While No. P 31 14 835.2 concerns a bank for accommodating print ram units, the present application describes the special features of the design of the electromagnetic actuators for the print ram units. Details of these are shown in FIGS. 4, 5 and 6.

Figures 4, 5, 6:
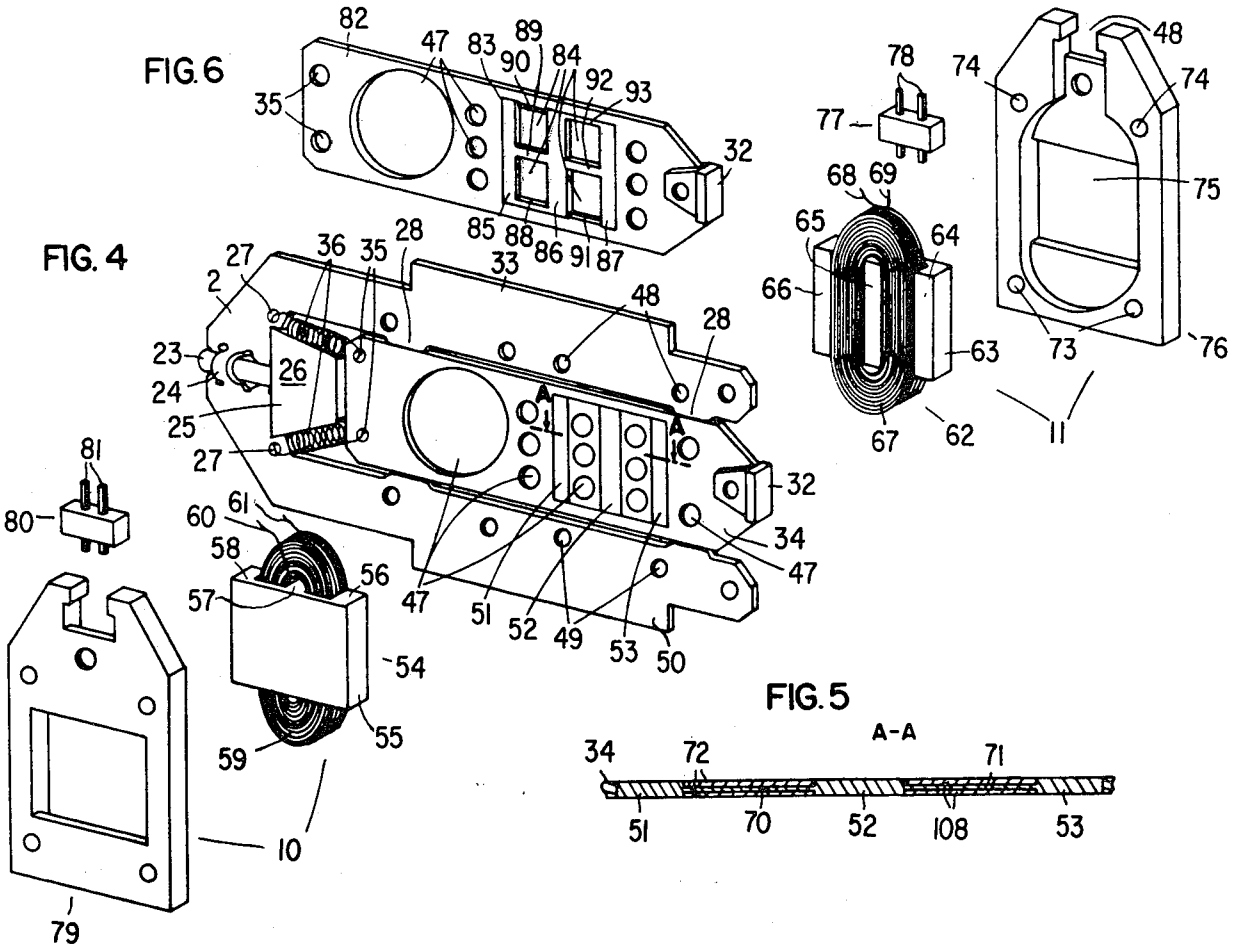
FIG. 4 is an exploded representation of a print ram unit with the appertaining electromagnetic actuators.
FIG. 5 is a sectional representation of the bar structure along line A—A in FIG. 4.
FIG. 6 shows a tongue-shaped ram, the design of whose magnetic bars differs from that in FIG. 4 and FIG. 5.

FIG. 4 is an exploded representation of a print ram unit with the appertaining electromagnetic actuators. Many components of FIG. 4 correspond to components with the same reference numbers in FIGS. 1 and 2. To avoid repetitions, such components in connection with FIG. 4 are referred to only briefly or not at all.

For weight reasons, the tongue-shaped ram 34, whose base part is made of plastic, is provided with bores 47 at different points. The soft-iron bars necessary for rendering the electromagnetic actuator effective are designated as 51, 52 and 53. The electromagnetic actuators 10 and 11 which are arranged aligned to each other on either side of the frame 2, each comprise one magnet yoke 55, 63 and an appertaining excitation coil 59, 67. The magnet yoke coil combinations are designated as 54 and 62. Each of these combinations is accommodated in a housing 79, 76 provided with a plug connector 80, 77 with the contacts 81, 78 for the excitation coils 59 and 67. These housings are fixed to the frame by means of screws, not shown, or other suitable fixing means. In housing 76 the appropriate fixing holes are designated as 74 and 73 and in frame 2 as 48 and 49. The fixing elements, not shown for the sake of clarity, ensure that the electromagnetic actuators are accurately positioned, particularly the operating gaps with respect to soft-iron bars in tongue-shaped ram 34. As mentioned in connection with the Patent Application Ser. No. 162,993 above, a magnetizable bar must be in front of the operating gap in the non-excited state of the electromagnets.

In the present case, magnet yokes 55 and 63 have and E-shaped cross-section. The E-shaped magnet yokes 63 and 55, arranged on opposite sides, are so aligned to each other that their legs 64, 65, 66 and 56, 57, 58 form a total of three operating gaps: The first operating gap lies between legs 64 and 56, the second one between legs 65 and 57 and the third one between legs 66 and 58. One of the three magnetizable bars 53, 52 and 51 is associated with each of these operating gaps. The excitation winding for each magnet yoke extends, as shown in FIG. 4, around the center E-leg so that the excitation coil can be produced separately as a flat slip-on coil for the center E-leg, with the strands of the coil extending parallel to each other fitting the spaces formed by the E-legs.

This special design of the magnet yoke excitation coils is extremely inexpensive and space-saving. The coil does not extend beyond the magnet yoke in the direction perpendicular to the ram plane. This is particularly important for a high packing density and minimum magnetic interaction of the print ram units in banks. In addition, the flat coil and the E-shaped magnet yoke permit the individual componets to be easily and inexpensively manufactured and to be assembled without any problems. The magnet yoke coil combination 62 is inserted into recess 75 of housing 76 and embedded in plastic. This applies by analogy to magnet yoke coil combination 54 and housing 79. It is expressly pointed out that in the interest of an accurate operation of the print ram actuator, the soft-iron bars in the print ram 34 should be inserted into the respective operating gaps of the electromagnet without undue tolerances. Consequently, the magnetizable bars must also be readily insertable into the plastic base part of ram 34.

It may generally be assumed that it is relatively easy to embed these bars in the plastic base part. It is more problematical however to accurately position the bars relative to each other. For this reason, the bars should be inserted into the ram as a continuous joint part, rather than individually. According to FIGS. 5 and 6, there are several alternatives for structuring such a part.

FIG. 5 shows a structure where magnetizable bars 51, 52 and 53 are continuously connected by the same magnetizable material with a smaller thickness. Thus, bars 51 and 52 are connected by connecting means 70 and bars 52 and 53 by connecting means 71. Such connecting means 70, 71 between the bars are undesirable for an optimum operation of the actuator. It has been found however that provided such connecting means are adequately thin, their negative influence on the efficiency is only slight and can, as a practical matter, be tolerated. Thus, it is possible to produce the bar structure as a continuous part and to easily embed this part into tongue-shaped ram 34. For this purpose, it is only necessary to suitably insert this part (rather than three individual bars) into ram 34. After this part has been inserted into the respective recess of the ram, it is sealed with plastic, also sealing previously empty recesses 71, 72 of the part up to the ram plane.

FIG. 6 shows another bar structure. The ram as such is designated as 82 and the ram head again as 32. The holes for accommodating the tension springs, not shown, (see FIG. 4) are designated as 35 and the material-saving bores, similar to FIG. 4, as 47.

Bar structure 83 has the shape of a four-quadrant rectangular frame with four openings 84. The frame elements essential for the operation of the ram are bars 85, 86 and 87. Bars 85 and 86 are connected by frame elements 88, 89 and 90 arranged transversely to them and made of the same material as the bars. Similarly, bars 86 and 87 are connected by frame elements 91, 92 and 93 arranged transversely to them and made of the same material. The transverse frame elements are smaller and thinner than the bars themselves, the frame opening being sealed with plastic up to the ram plane.

While the present invention has been particularly described with reference to the preferred embodiment thereof, it will be understood by those skilled in the art that various changes in form and detail may be made therein, without departing from the spirit and scope of the invention as illustrated in the appended claims.

We claim:

1. An electromagnetic ram actuator comprising:

an electromagnetic, said electromagnetic further comprising:

a first symmetrical magnetizable E-shaped yoke half having pole end faces and legs;

a second symmetrical magnetizable E-shaped yoke half having pole end faces and legs whose pole ends face the pole ends of said first E-shaped yoke half to form a plurality of aligned operating gaps;

a first coil for energizing said first E-shaped yoke half extending between the legs of said first E-shaped yoke half, a second coil for energizing said second E-shaped yoke half extending between the legs of said second E-shaped yoke half; and a tongue-shaped ram perpendicular to said first E-shaped yoke half and said second E-shaped yoke half, said ram arranged between said operating gaps and shiftable in the direction of the line of alignment of said operating gaps, said ram further comprising:

a plurality of armature bars of magnetizable material, each of said armature bars being associated with one of said operating gaps, the size of said armature bars each being approximately equal to the size of one of said operating gaps;

wherein said armature bars are positioned in front of said operating gaps when said electromagnet is in a non-energized state and upon energization of said electromagnet, said armature bars are pulled into said operating gaps.

2. An electromagnetic ram actuator comprising:

an electromagnet, said electromagnet further comprising:

a first symmetrical magnetizable yoke half having more than one pole end;

a second symmetrical magnetizable yoke half having more than one pole end whose pole ends face the pole ends of said first yoke half to form a plurality of aligned operating gaps;

a first coil for energizing said first yoke half embracing said first yoke half;

a second coil for energizing said second yoke half embracing said second yoke half;

a tongue-shaped ram, said ram arranged between said operating gaps and shiftable in the direction of the line of alignment of said operating gaps, said ram further comprising:

a plurlity of armature bars of magnetizable material, each of said armature bars being associated with one of said operating gaps, the size of said armature bars each being approximately equal to the size of one of said operating gaps;

a plurality of connecting means of magnetizable material, said connecting means interconnecting said armature bars to form a continuous element;

wherein said armature bars are positioned in front of said operating gaps when said electromagnet is in a non-energized state and upon energization of said electromagnet, said armature bars are pulled into said operating gaps.

3. An electromagnetic ram actuator according to claim 2 wherein said connecting means are narrower than said armature bars in the direction of the alignment of the pole ends of said first yoke half and the pole ends of said second yoke half.

4. An electromagnetic ram actuator according to claims 2 or 3 wherein said connecting means are narrow interconnecting strips between said armature bars.

5. An electromagnetic ram actuator according to claim 3 wherein said connecting means and said armature bars have a four-quadrant-shaped frame structure.

* * * * *